US011054228B2

(12) United States Patent
Romero

(10) Patent No.: US 11,054,228 B2
(45) Date of Patent: Jul. 6, 2021

(54) HYBRID MECHANICAL BROADHEAD

(71) Applicant: R.R.A.D. LLC, Newport, NC (US)

(72) Inventor: Scott Romero, Newport, NC (US)

(73) Assignee: RRAD, LLC, Newport, NC (US)

( * ) Notice: Subject to any disclaimer, the term of this patent is extended or adjusted under 35 U.S.C. 154(b) by 0 days.

(21) Appl. No.: 15/931,444

(22) Filed: May 13, 2020

(65) Prior Publication Data

US 2020/0363174 A1 Nov. 19, 2020

Related U.S. Application Data

(60) Provisional application No. 62/847,176, filed on May 13, 2019.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 4,099,720 | A * | 7/1978 | Zeren | F42B 6/08 473/584 |
| 9,303,963 | B1 * | 4/2016 | Ford | F42B 6/08 |
| 9,341,449 | B2 * | 5/2016 | Pedersen | F42B 6/08 |
| 9,976,835 | B2 * | 5/2018 | Pedersen | F42B 6/08 |
| 10,393,485 | B1 * | 8/2019 | Painter | F42B 6/08 |
| 10,458,763 | B2 * | 10/2019 | Blosser | F42B 6/08 |
| 2016/0273892 | A1 * | 9/2016 | Pedersen | F42B 6/08 |
| 2020/0003532 | A1 * | 1/2020 | Blosser | F42B 6/08 |

* cited by examiner

*Primary Examiner* — John A Ricci
(74) *Attorney, Agent, or Firm* — Eric B. Fugett; Mark A. Pitchford; Pitchford Fugett, PLLC

(57) ABSTRACT

A hybrid mechanical broadhead for an archery bow and arrow (e.g., recurve bow, compound bow, or crossbow) has at least one pivoting blade. In a retracted position, a cutting edge of the pivoting blade folds forward into an elongated body of the broadhead. A hook protrusion and blunt edge are externally exposed in the retracted position, and the hook protrusion is configured to rotate the blade to a deployed position, exposing the cutting edge of the blade. The blade may be locked into the deployed position by tightening a threaded fastener onto the blade or by placing an annular band around the hook protrusion and elongated body. An annular collar may be used to place the band about the hook portion, and forcing the blade into the retracted position moves the band forward on the broadhead, securing the blade in the retracted position.

18 Claims, 7 Drawing Sheets

HYBRID MECHANICAL BROADHEAD

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims priority to U.S. Provisional Patent Application Ser. No. 62/847,176 filed on May 13, 2019 entitled "HYBRID MECHANICAL BROADHEAD."

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to the field of archery. More specifically, the present invention relates to a mechanical (i.e., expandable) broadhead with flip out blades.

Two major categories of broadheads are fixed-blade broadheads and mechanical (i.e., expandable) broadheads. Fixed-blade broadheads are generally stronger, easier to maintain, more reliable, and can be fired from low-draw weight bows. However, fixed-blade broadheads often have reduced accuracy and narrower cutting diameter than mechanical broadheads, and the blades can act as barbs that prevent extraction of the arrow from a target or game animal.

By contrast, mechanical broadheads are more stable in flight, have a greater cutting diameter, and are more accurate (by virtue of being less affected by wind during flight) than fixed-blade broadheads. However, mechanical broadheads are not legal for hunting in some states, more prone to failure, and tend to require firing from a high draw weight bow in order to provide the necessary energy to expand the blades and expose the cutting edges upon impact with a target.

BRIEF SUMMARY OF THE INVENTION

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Aspects of the present invention provide a hybrid mechanical broadhead for use with an archery bow and arrow (e.g., recurve bow, compound bow, or crossbow). The broadhead has at least one pivoting blade. A cutting edge of the pivoting blade folds forward into an elongated body of the broadhead when the blade is in a retracted position. A hook protrusion and blunt edge are externally exposed in the retracted position, and the hook protrusion is used to rotate the blade to a deployed position, exposing the cutting edge of the blade to the exterior of the broadhead. The blade may be locked into the deployed position by use of a threaded fastener tightening on the blade, or by placing an annular band around the hook protrusion and elongated body. An annular collar may be used to place the band, about the hook portion, and forcing the blade into the retracted position moves the band forward on the broadhead, securing the blade in the retracted position until impact with a target (or manual rotation of the blade via the hook protrusion).

One aspect of the disclosure is a novel hybrid mechanical broadhead that can be easily and quickly placed into a mechanical or a fixed-blade configuration and shot as either a mechanical broadhead or a fixed-blade broadhead. The broadhead can comprise an elongated body including a longitudinal axis, an elongated slot, and an at least partially threaded passage extending through a portion of the body, the passage intersecting the slot; a blade at least partially received in the slot, the blade configured to pivot relative to the body between a retracted position generally adjacent to the body and a deployed position extending generally outwardly from the body; a threaded fastener extending through the portion of the blade received in the slot, the threaded fastener releasably engaged with the passage to selectably retain the blade in the slot; wherein the threaded fastener is selectably operable to releasably lock the blade in the deployed position or permit the blade to freely pivot between the retracted position and the deployed position.

In one aspect, a broadhead includes an elongated body, a blade, and a threaded fastener. The elongated body extends along a longitudinal axis. The elongated body has an elongated slot and a passage extending through portion of the body. The passage intersects the slot. The blade is at least partially received in the slot when the broadhead is assembled. The blade is configured to pivot relative to the elongated body between a retracted position and a deployed position. The threaded fasteners configured to threadingly engage the passage while extending through a hole in the blade received in the slot to retain the blade in the slot such that the blade rotates about the threaded fastener from the retracted position to the deployed position and from the deployed position to the retracted position when the broadhead is assembled. The threaded fastener is operable to selectively lock the blade in the deployed position or permit the blade to freely pivot between the retracted position in the deployed position.

In another aspect, a broadhead includes an elongated body, a blade, a faster, and an annular collar. The elongated body extends along a longitudinal axis. The elongated body has an elongated slot and a passage extending through portion of the body. The passage intersects the slot. The blade is at least partially received in the slot when the broadhead is assembled. The blade is configured to pivot relative to the elongated body between a retracted position and a deployed physician. The fasteners configured to extend through a hole in the blade received in the elongated slot to retain the blade in the slot such that the blade rotates about the fastener from the retracted position to the deployed position and from the deployed position to the retracted position when the broadhead is assembled. The annular collar is configured to slide onto the elongated body of the broadhead from the rear of the elongated body. The annular collar includes a recess and a channel. The recess is in a forward end of the annular collar. The channel is recessed from an exterior circumferential surface of the annular collar. The recess in the forward end of the annular collar is configured to receive the blade of the broadhead when the blade is in the deployed position. The channel is configured to receive a resilient annular band.

In another aspect, a broadhead includes an annular collar. The annular collar includes a recess and a channel. The recess is in a forward end of the annular collar. The channel is recessed from an exterior circumferential surface of the annular collar. The recess in the forward end of the annular collar is configured to receive the blade of the broadhead when the blade is in the deployed position. The channel is configured to receive a resilient annular band.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 3:
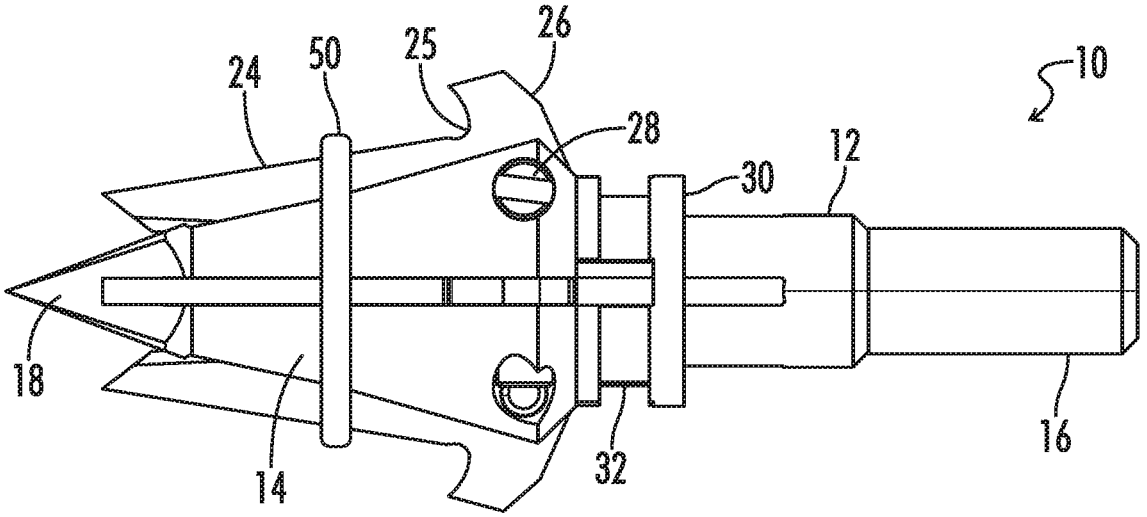
FIG. 3 is a side perspective view of the broadhead of FIG. 1 with blades in the retracted position.
Figure 4:
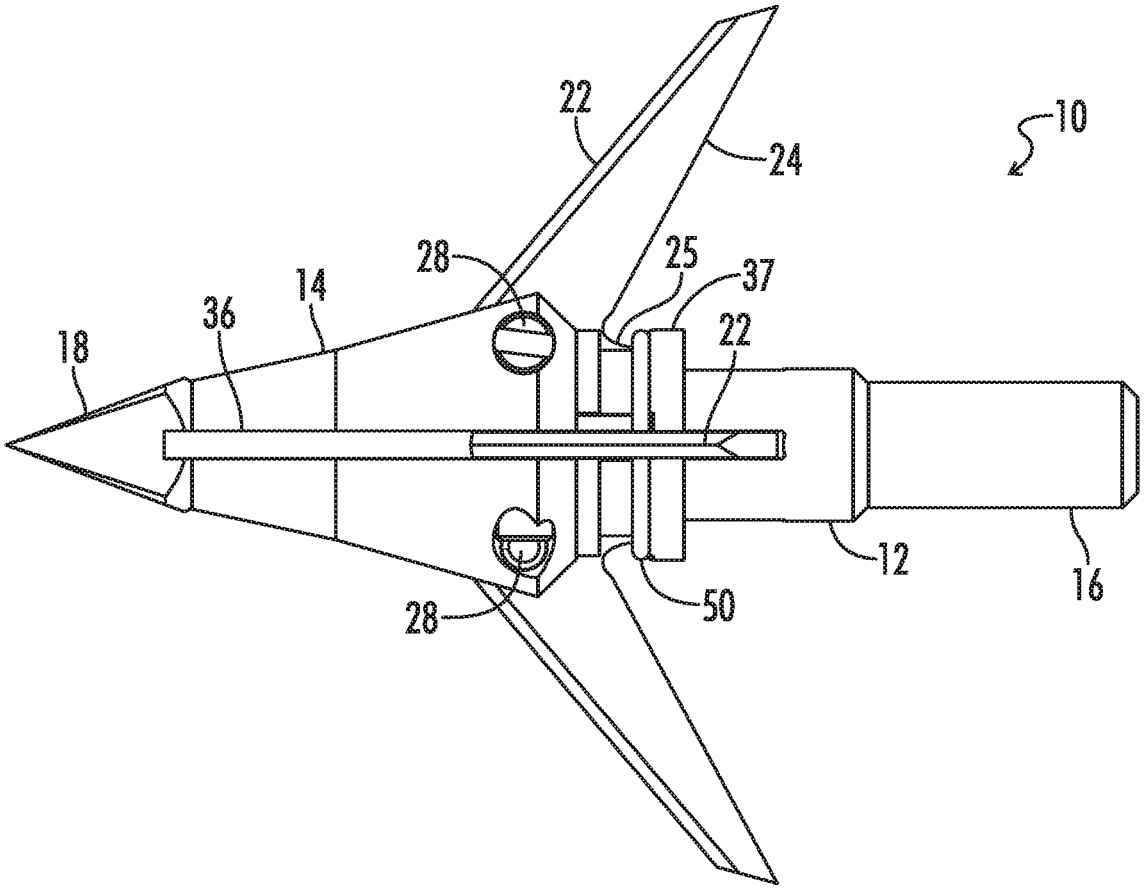
FIG. 4 is a side perspective view of the broadhead of FIG. 1 with blades in the deployed position.
Figure 5:
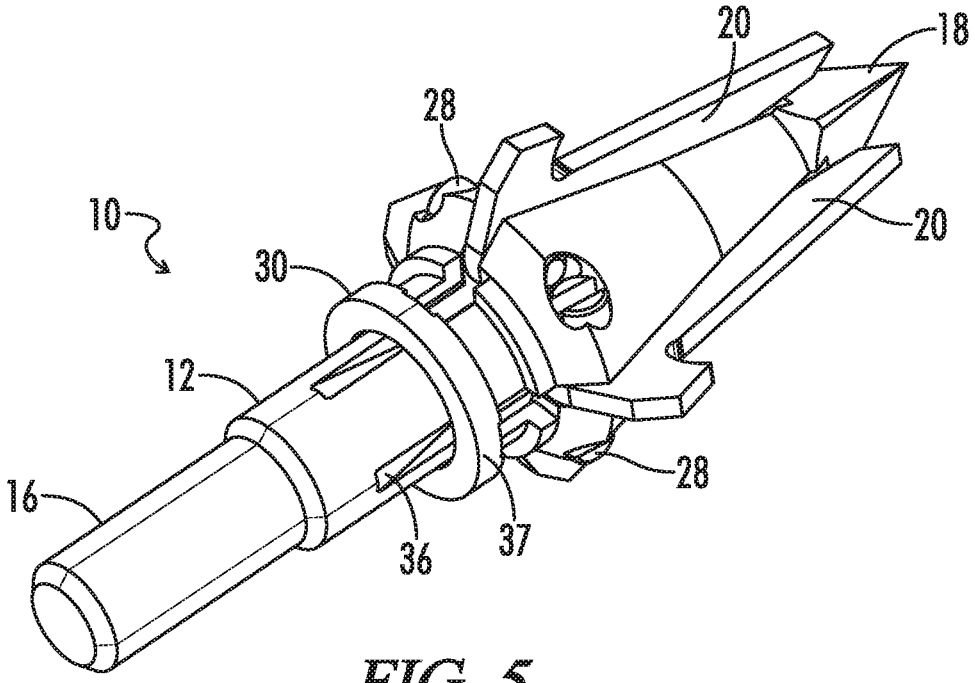
FIG. 5 is a rear isometric view of the broadhead of FIG. 1 with blades in the retracted position.
Figure 6:
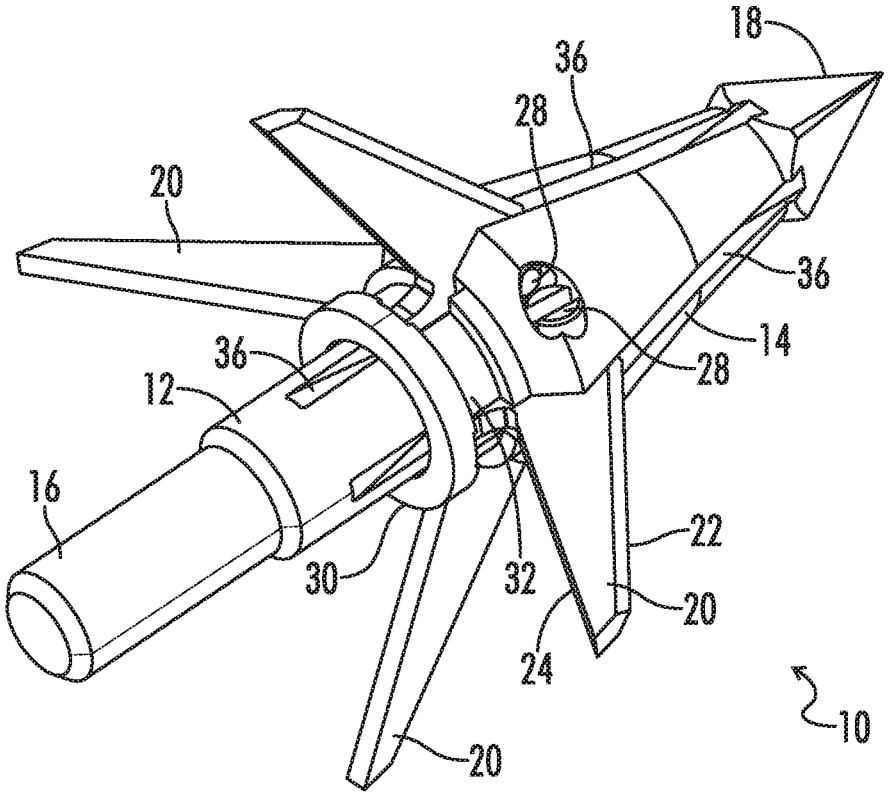
FIG. 6 is a rear isometric view of the broadhead of FIG. 1 with blades in the deployed position.
Figure 7:
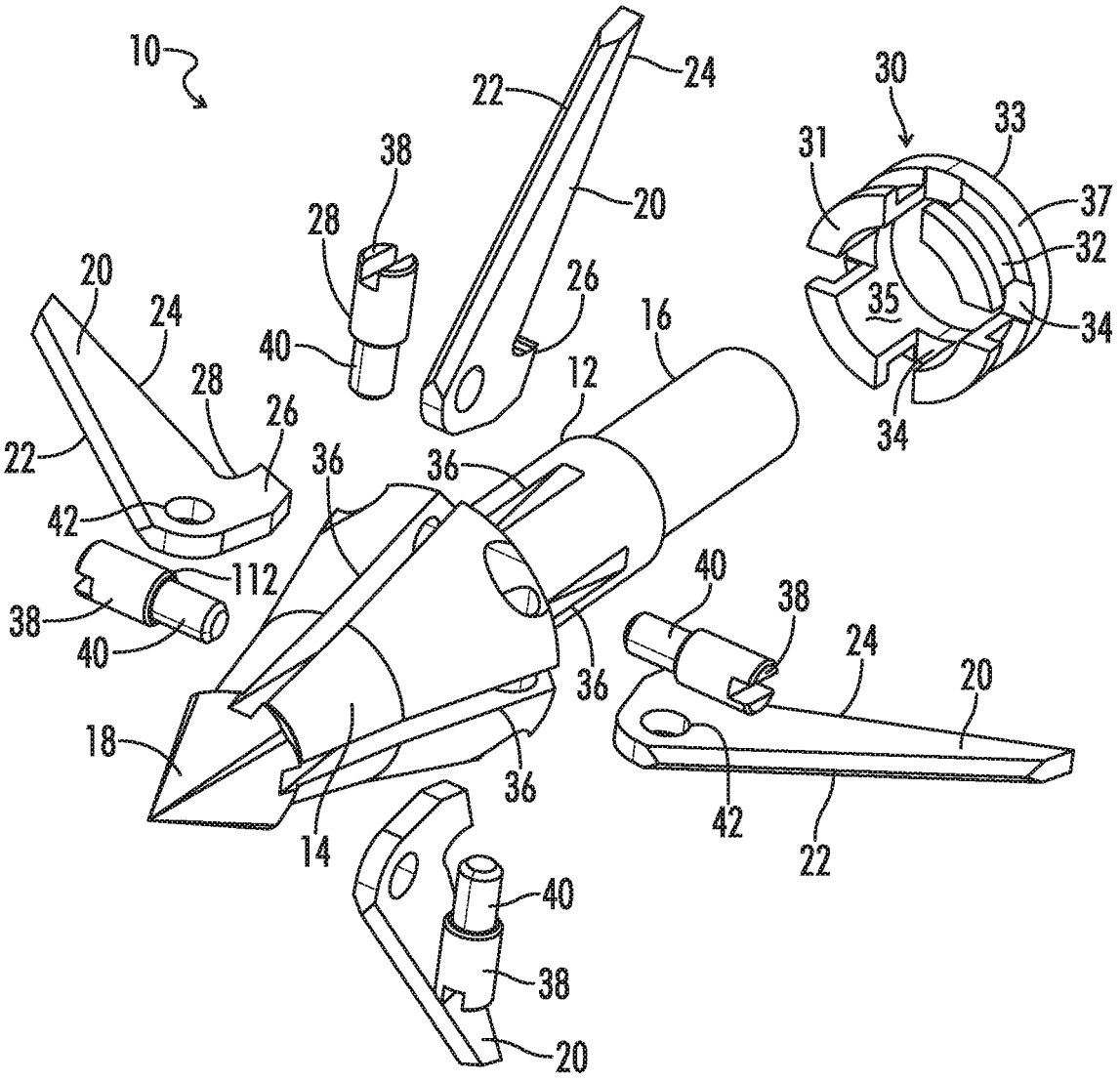
FIG. 7 is an exploded front isometric view of the broadhead of FIG. 1 with blades in the deployed position.
Figure 8:
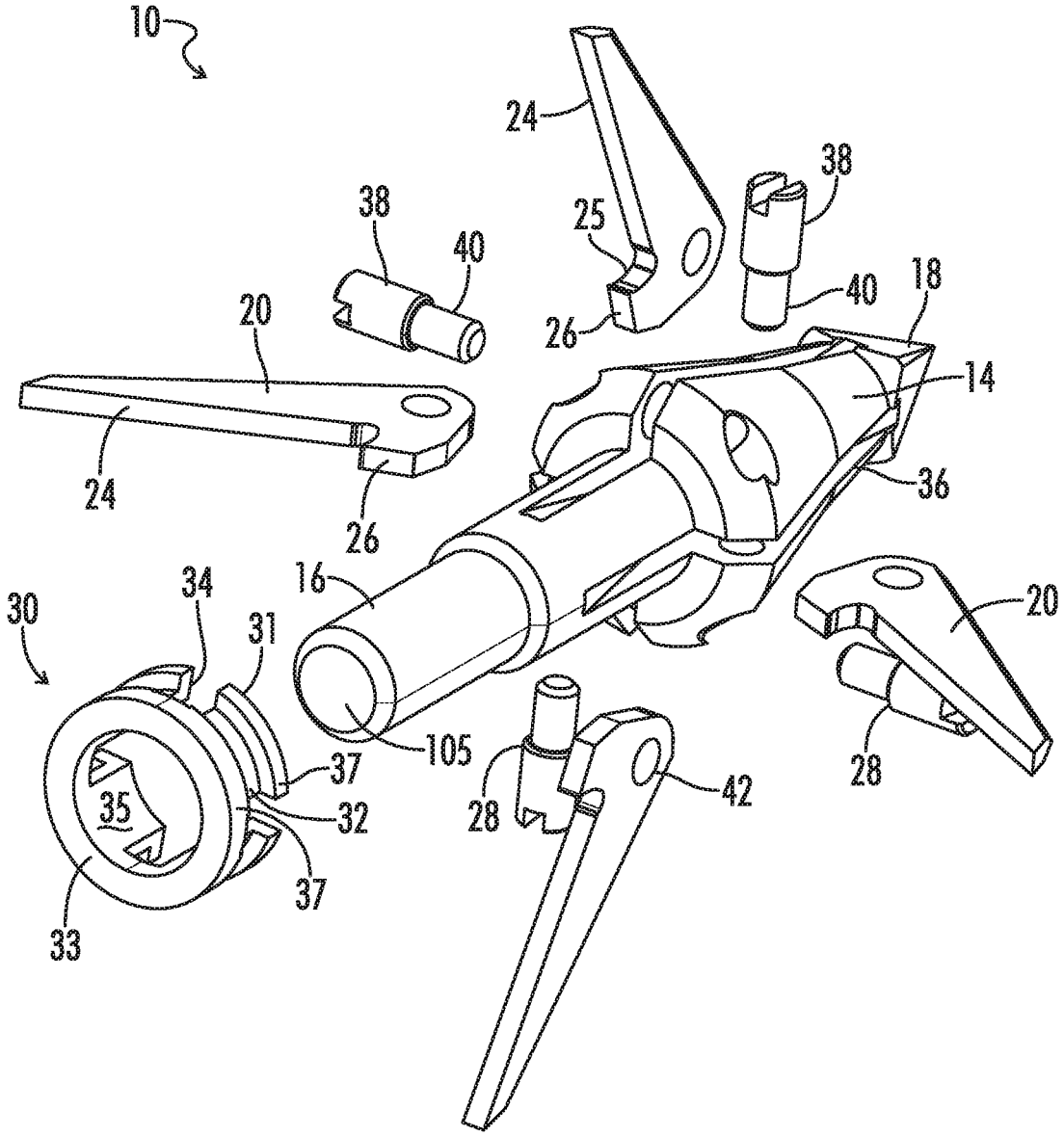
FIG. 8 is an exploded rear isometric view of the broadhead of FIG. 1 with blades in the deployed position.

As described herein, an upright, assembled position is considered to be the position of apparatus components while in proper operation or in a natural resting position as described herein. Vertical, horizontal, above, below, side, top, bottom and other orientation terms are described with respect to this upright position during operation unless otherwise specified. As used herein, the assembled and upright position is the broadhead with fasteners holding the folding blades in blade slots of an elongated body with an annular ring on the elongated body and the elongated body extending along a generally horizontal longitudinal axis such as shown in FIGS. 3 and 4. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states.

As used herein, the terms "pivots," "pivot" or "pivoting" mean substantially rotational movement of an item relative to another item. Similarly, the term "pivotable" refers to an item capable of pivoting relative to another item.

Referring to FIGS. 1-10, there is shown a hybrid mechanical broadhead 10 formed in accordance with one embodiment of the present invention. The broadhead 10 includes an elongated body (e.g., a ferrule) 12 having a longitudinal axis 13, a generally conical forward portion 14, a generally cylindrical rearward portion 16 spaced rearwardly from the forward portion 14, and a chisel point tip portion 18. In some alternate embodiments, the tip portion 18 can include, instead of a chisel point, a tip blade, a tip blade assembly, or a socket configured to receive a removable arrow point, tip blade, or tip blade assembly. To enable the broadhead 10 to be releasably engaged with an arrow, the rearward portion 16 of the elongated body 12 is threaded with screw threads complimentary to the threads of a threaded socket formed in the forward end of an arrow (i.e., arrow or bolt).

Figure 1:
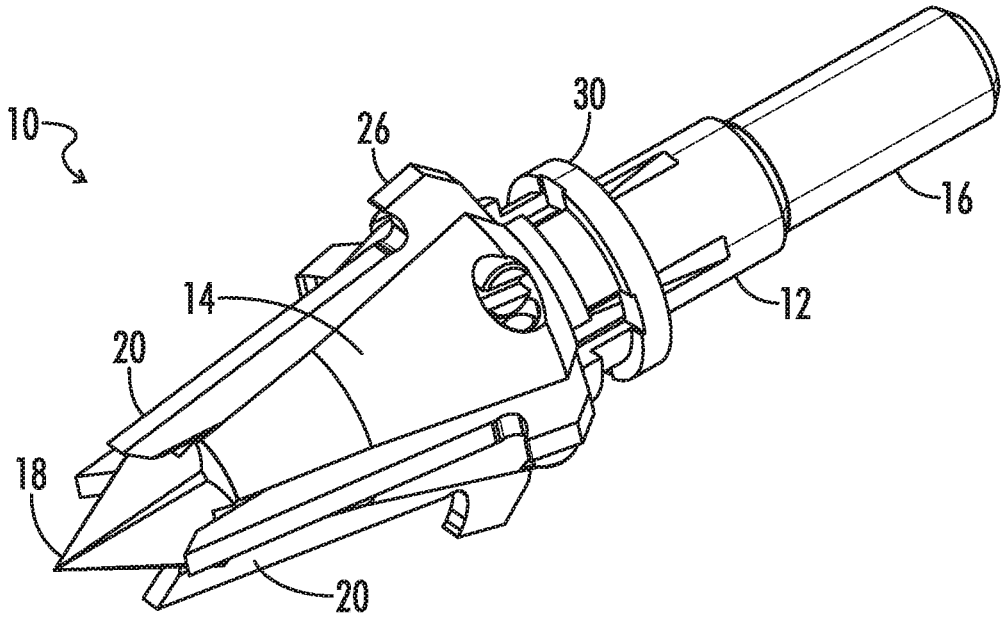
FIG. 1 is an isometric view of a hybrid mechanical broadhead with blades in a retracted position from a front of the broadhead in accordance with an embodiment of the present disclosure.
Figure 2:
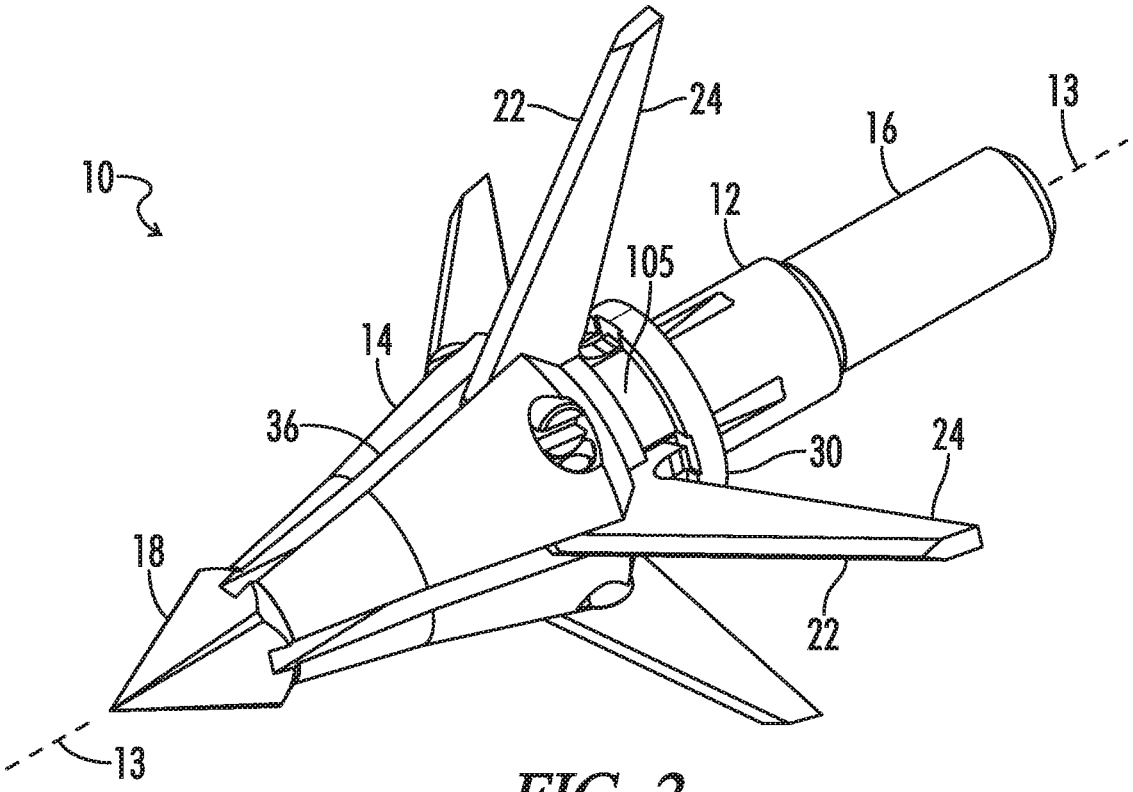
FIG. 2 is an isometric view the broadhead of FIG. 1 from a front of the broadhead with blades in a deployed position.

A plurality of blades 20 are pivotally connected to the forward portion 14 of elongated body 12 and configured for pivotal movement relative to elongated body 12. In a retracted position, blades 20 are generally adjacent elongated body 12 as shown in FIG. 1. In an extended or deployed position, blades 20 extend generally outwardly from the body 12 as shown in FIG. 2. Each blade 20 includes a forward cutting edge 22, a rear blunt edge 24, a hooked protrusion 26 extending from a portion of the blunt edge 24, and a hole 42. The blades 20 are received in elongated blade slots 36 formed in body 12. The blade slots 36 stabilize and maintain the blades 20 in their respective planes both during flight and when the broadhead 10 impacts a target. Each blade 20 is connected to the elongated body 12 by a fastener such as a blade screw 28. Each blade screw 28 includes a head portion 38 and a threaded portion 40. The head portion 38 of each blade screw 28 has a diameter greater than a diameter of the threaded portion 40 of the screw 28.

Figure 9:
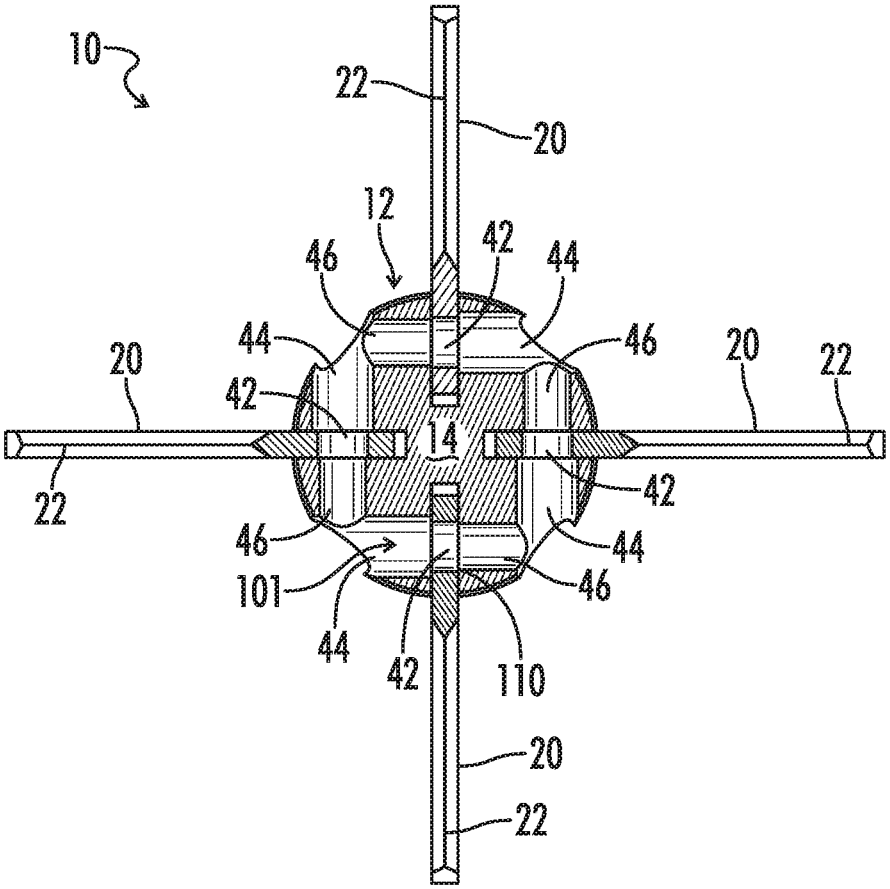
FIG. 9 is a front cutaway view of the broadhead of FIG. 1 with blades in the deployed position and blade screws removed for clarity.

As best shown in FIG. 9, the body 12 further includes a plurality of paired major and minor apertures 44, 46, respectively, that are coaxially aligned to form passages through the elongated body 12 in which blade screws 28 are removably receivable to pivotably connect the blades 20 to the body 12. Major apertures 44 have a smooth interior surface and a larger diameter than minor apertures 46, which are threaded with threads complimentary to the threads of blade screws 28. Each major and minor aperture 44, 46 extends through a portion of the body 12 distal to the longitudinal axis 13 at an angle generally transverse to the longitudinal axis 13 and intersects a blade slot 36. Each major aperture 44 is formed in the body 12 on the opposite side of the blade slot 36 from its respective paired minor aperture 46. The passage formed by each pair of major and minor apertures 44, 46 is coaxial with the hole 42 of a blade 20 when the blade 20 is received in its respective blade slot 36. As such, when a blade 20 is releasably connected to the elongated body 12 by a blade screw 28 received in the passage formed by a pair of major and minor apertures 44, 46, the threaded portion 40 of the screw 28 extends through the blade hole 42 and into the threaded minor aperture 46. It is contemplated within the scope of the claims that the fasteners 28 may be pins pressed into the passages through the hole 42 in the blade 20 to pivotally retain the blade 20 to the elongated body 12.

Figure 10:
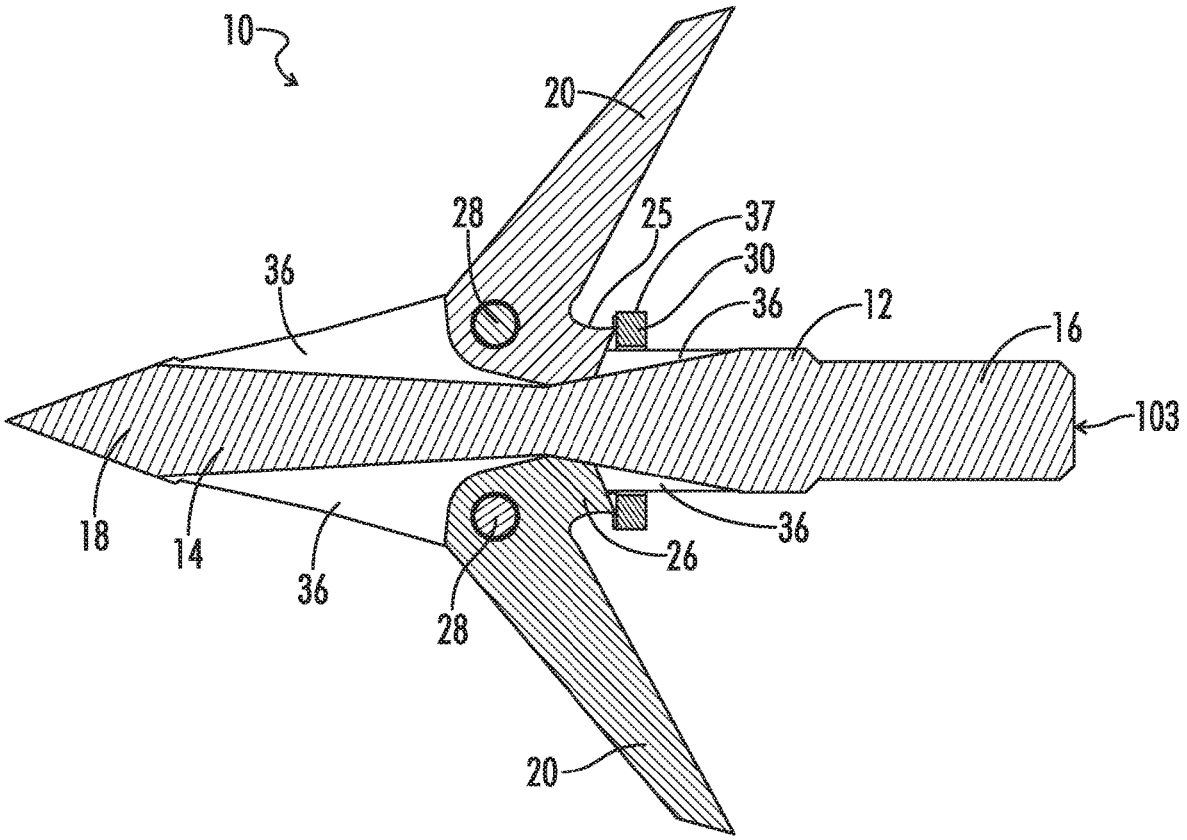
FIG. 10 is a side cutaway view of the broadhead of FIG. 1 with blades in the deployed position.

In one embodiment, the broadhead 10 further includes an annular collar 30 mounted on a portion of the elongated body 12 rearward of blade screws 28 about which blades 20 pivot. The broadhead 10 is assembled by sliding (e.g., pushing or screwing) the collar onto the elongated body 12 from the rear end of the elongated body 12. The collar 30 includes a forward end 31, a rearward end 33, an interior circumferential surface 35, an exterior circumferential surface 37 in which an encircling channel 32 is defined, and a plurality of recesses 34 defined in the forward end 31. The collar 30 is oriented on the elongated body 12 such that the recesses 34 in the forward end are aligned with the blade slots 36 formed in the body 12. The recesses 34 are shaped and sized to receive and support the rear blunt edge 24 of each blade 20 when the blades 20 are in the deployed position. In this way, the collar recesses 34 further stabilize and maintain the blades 20 in their respective deployed positions. Additionally, when the blades 20 are seated in their respective collar recesses 34, the inner bend 25 of each hooked protrusion 26 is positioned in the channel 32 below (i.e., radially inward of the channel 32 with respect to the longitudinal axis 13) the exterior circumferential surface of the collar 30, as best illustrated in FIG. 10.

In one embodiment, the assembled broadhead 10 can be selectably configured according to the preference of a user for use either as a non-barbed, fixed-blade broadhead or a mechanical (i.e., expandable) broadhead by manually moving the blades 20 to the retracted position or deployed position and loosening or tightening the screws 28 of each blade 20 as appropriate.

For example, the broadhead 10 can be configured for use as a fixed-blade broadhead by placing the blades 20 in the deployed position and tightening the blade screws 28 until the blades no longer pivot freely under finger pressure. In addition to preventing the blades from making undesirable noise (e.g., rattling), this releasably locks the blades 20 in the deployed position and thereby permits the broadhead 10 to be fired as a fixed-blade broadhead. Once releasably locked in the fixed-blade configuration, the blades 20 will remain in the deployed position during flight and penetration of a target. Importantly, however, the blades 20 will release (i.e., unlock) and pivot forward toward the retracted position during extraction of the broadhead 10 from a target. This prevents the blades 20 from functioning as barbs and causing the broadhead 10 to become stuck in the target. The threaded portion 40 of each blade screw 28 is provided with threads having a major diameter greater than the diameter of the hole 42 in each blade 20 in order to releasably lock the blades 20 in the deployed position, and thus the broadhead in the fix-blade configuration.

In order to help maintain the broadhead 10 in the fixed-blade configuration, a resilient annular strap or band 50 is receivable in collar channel 32 (and thus in the inner bend 25 of each hooked protrusion 26) when the blades 20 are seated in their respective collar recesses 34 to retain the blades 20 in the deployed position when broadhead 10 is in flight.

By way of further example, the broadhead 10 can be configured for use as a mechanical (i.e., expandable) broadhead by loosening the screws 28 until the blades pivot freely (i.e., pivotable with the application of very little force, such as by gravity or momentum shift) between the deployed and retracted position. Once the blade screws 28 are sufficiently loose to allow pivotal movement of the blades 20, the blades 20 can be placed in the retracted position by manually flipping each blade 20 forward toward the tip portion 18. The annular strap or band 50 can be placed around the rear blunt edges 24 of the blades 20 to retain the blades 20 in the retracted position during flight. Notably, if the band 50 is received in collar channel 32 when the blades 20 are manually moved from the deployed position to the retracted position, hooked blade protrusions 26 will carry band 50 forward in the inner bend 25 of each protrusion as the blades 20 are rotated (e.g., manually rotated by a user) or pivoted into the retracted position. Once the blades are in the retracted position, the band 50 will move slightly forward out of the inner bend 25 of each hooked protrusion 26 to rest on the rear blunt edges 24 of the blades 20. Upon impacting a target, the blades 20 will flip open due to force applied to forward ends of the cutting edges 22 and hook protrusions 26 by the target, sever the band 50, and pivot back (i.e., rearward) toward the deployed position as the broadhead 10 penetrates the target. As with the fixed-blade configuration, the blades 20 will pivot forward toward the retracted position during extraction of the broadhead 10 from a target, even if the band 50 has not severed. The hook protrusions 26 will again move the band 50 forward onto blunt edges 24 of the blades 20.

In one embodiment, a broadhead 10 includes an elongated body 12, a blade 20, and a fastener 28. The elongated body 12 extends along a longitudinal axis 13. The elongated body 12 has an elongated slot 36 in the passage 101 extending through a portion of the elongated body 12. The passage 101 intersects the slot 36. The blade 20 is at least partially received in the slot 36 when the broadhead 10 is assembled. The blade 20 is configured to pivot relative to the elongated body 12 between the retracted position and a deployed position. The fastener 28 is configured to extend through a hole 42 in the blade 20 received in the elongated slot 36 to retain the blade 20 in the slot 36 such that the blade 20 rotates about the fastener 28 from the retracted position to the deployed position and from the deployed position to the retracted position.

In one embodiment, the broadhead 10 further includes an annular collar 30. The collar 30 is configured to slide onto the elongated body 12 of the broadhead 10 from the rear 103 of the elongated body 12. The annular collar 30 includes a recess 34 in a forward end 31 of the annular collar 30, and a channel 32 recessed from an exterior circumferential surface 37 of the annular collar 30. The recess 34 in the forward end 31 of the annular collar 30 is configured to receive the blade 20 of the broadhead 10 when the blade 20 is in the deployed position. The channel 32 is configured to receive a resilient annular band 50. In one embodiment, the broadhead 10 further includes the resilient annular band 50.

In one embodiment, a portion of the blade 20 extends into the recess 34 in the forward end 31 of the caller 30 as the blade 20 pivots from the deployed position to the retracted position and back to the deployed position such that the blade 20 maintains alignment of the recess 34 with the blade 20 and blade slot 36 when the broadhead 10 is assembled.

In one embodiment, the blade 20 further includes a hooked protrusion 26 configured to be received in the recess 34 of the annular collar 30 when the blade 20 is in the deployed position. The hooked protrusion 26 of the blade 20 extends radially from the longitudinal axis 13 of the broadhead 10 less than the exterior circumferential surface 37 of the annular collar 30 when the broadhead 10 is assembled and the blade 20 is in the deployed position. In one embodiment, the hooked protrusion 26 the blade 20 extends radially from the longitudinal axis 13 of the broadhead more than a bottom 105 of the channel 32 of the annular collar 30 when the broadhead 10 is assembled in the blade 20 is in the deployed position. In one embodiment, the channel 32 extends longitudinally relative to the longitudinal axis 13 less than the band 50 such that when the band 50 is in the channel 32, as the annular collar 30 is slid onto the rear 103 of the elongated body 12 with the blade 20 in the deployed position, the band 50 slides or roles forward onto the hooked protrusion 26 of the blade 20 while remaining in the channel 32, securing the blade 20 in the deployed position. In one embodiment, as the annular collar 30 is slid onto the rear 103 of the elongated body 12 with the blade 20 in the deployed position, the annular band 50 becomes longitudinally lined with an radially outward of the hooked protrusion 26 of the blade 20 such that is the blade 20 is pivoted from the deployed position to the retracted position, the annular band 50 is move forward with respect to the elongated body 12 and the longitudinal axis 13 of the elongated body 12 onto a rear blunt edge 24 of the blade 20 to secure the blade 20 in the retracted position. In one embodiment, the hooked protrusion 26 of the blade is configured to contact a target upon impact of the broadhead 10 with the target when fired and force the blade 20 from the retracted position to the deployed position. In one embodiment, the retracted position of the blade 20 is adjacent to the body 12 with a forward cutting edge 22 of the blade 20 received in the elongated slot 36, and the deployed position of the blade 20 is generally extending outwardly from the body 12 with the forward cutting edge 26 of the blade 20 exposed and viewable from a forward end 18 of the elongated body.

In one embodiment, the passage 101 is partially threaded, and the fastener 28 is configured to threadingly engage the passage 101 while extending through the hole 42 in the blade 20 when the broadhead 10 is assembled. The threaded fastener 28 is operable to selectively lock the blade 20 in the deployed position or permit the blade 22 pivot or rotate about the threaded fastener 28 between the retracted position and the deployed position of the blade 20. In one embodiment, the passage 101 extends along a line, and a plane containing the line is orthogonal to the longitudinal axis 13 of the elongated body 12. In other words, the elongated slot 36 extends along a plane containing the longitudinal axis 13, and the blade 20 lies in and rotates in a plane containing the longitudinal axis 13 when the broadhead 10 is assembled. In one embodiment, the fastener 28 selectively locks the blade in the deployed position when tightening against the threads of the passage the fastener 28 is tightened and that the passage 101 by rotating the same direction as the blade 20 rotates when pivoting from the retracted position to the deployed position.

In one embodiment, the passage 101 includes a minor aperture 46 that is threaded, and a major aperture 44. A diameter of the major aperture 44 is larger than a diameter of the minor aperture 46 such that a passage shoulder 110 is formed between the minor aperture 46 and the major aperture 44. The threaded fastener 28 includes a threaded portion 40 and a head portion 38. The threaded portion 40 is configured to at least partially threadingly engage the minor aperture 46 of the passage 101. The head portion 38 is configured to insert at least partially into the major aperture 44 of the passage 101. The head portion 38 has a larger diameter than the threaded portion 40 such that a fastener shoulder 112 is formed between the threaded portion 40 and the head portion 38 of the fastener 28. When the broadhead 10 is assembled, the threaded fastener 28 selectively locks the blade 20 into the deployed position by pressing the blade 20 between the shoulder 112 of the fastener 28 and the shoulder 110 of the passage 101 when the fastener 28 is tightened into the passage 101. The fastener 28 selectively allows the blade 20 to pivot between the retracted position in the deployed position when the fastener 28 is loosened from the passage 101, reducing pressure on the blade 20 between the shoulder 110 of the passage in the shoulder 112 of the fastener 28.

In one embodiment, the broadhead 10 includes a plurality of blades 20 and a plurality of corresponding fasteners 28. The recess 34 in the forward end 31 of the annular collar 30 is one of a plurality of recesses, and a plurality of the recesses 34 and the forward end 31 of the annular collar 30 are configured to receive a blade 20 of the plurality of blades 20 when the broadhead 10 is assembled with the annular collar 50 having been slid onto the rear 103 of the elongated body 12.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful HYBRID MECHANICAL BROADHEAD it is not intended that such references be construed as limitations upon the scope of this invention except as set forth in the following claims.

What is claimed is:

1. A broadhead, comprising:

an elongated body extending along a longitudinal axis, said elongated body having an elongated slot and a passage extending through a portion of the elongated body, said passage intersecting the slot;

a blade at least partially received in the slot when the broadhead is assembled, wherein the blade is configured to pivot relative to the elongated body between a retracted position and a deployed position; and a threaded fastener configured to threadingly engage the passage while extending through a hole in the blade received in the slot to retain the blade in the slot such that the blade rotates about the threaded fastener from the retracted position to the deployed position and from the deployed position to the retracted position when the broadhead is assembled;

wherein the threaded fastener is operable to selectively lock the blade in the deployed position or permit the blade to pivot between the retracted position and the deployed position.

2. The broadhead of claim 1, wherein:

the retracted position of the blade is adjacent to the elongated body with a forward cutting edge of the blade received in the elongated slot; and the deployed position of the blade is generally extending outwardly from the elongated body with the forward cutting edge of the blade exposed and viewable from a forward end of the elongated body.

3. The broadhead of claim 1, wherein:

the passage is partially threaded.

4. The broadhead of claim 1, wherein:

the passage extends along a line, and a plane containing the line is orthogonal to the longitudinal axis of the elongated body.

5. The broadhead of claim 1, wherein:

the elongated slot extends along a plane containing the longitudinal axis.

6. The broadhead of claim 1, wherein:

the fastener selectively locks the blade in the deployed position when tightened against the threads; and the fastener is tightened into the passage by rotating in the same direction as the blade when pivoting from the retracted position to the deployed position.

7. The broadhead of claim 1, wherein:

the passage comprises:

a minor aperture that is threaded; and a major aperture, wherein a diameter of the major aperture is larger than a diameter of the minor aperture such that a shoulder is formed between the minor aperture and the major aperture; and the fastener comprises:

a threaded portion configured to at least partially threadingly engage the minor aperture of the passage; and a head portion configured to insert at least partially into the major aperture of the passage, wherein the head portion has a larger diameter than the threaded portion such that a shoulder is formed between the threaded portion and the head portion of the fastener; wherein:

when the broadhead is assembled, the fastener selectively locks the blade into the deployed position by pressing the blade between the shoulder of the fastener and the shoulder of the passage when the fastener is tightened into the passage, and selectively allows the blade to pivot between the retracted position and the deployed position when the fastener is loosened from the passage, reducing pressure on the blade between the shoulder of the passage and the shoulder of the fastener.

8. The broadhead of claim 1, further comprising:

a resilient annular band;

an annular collar configured to slide onto the elongated body from a rear of the elongated body, said annular collar comprising:

a recess in a forward end of the annular collar; and a channel recessed from an exterior circumferential surface of the annular collar; wherein:

the recess in the forward end of the annular collar is configured to receive the blade when the blade is in the deployed position; and the channel is configured to receive the band; and a plurality of blades wherein the blade is one blade of the plurality of blades; and a plurality of fasteners wherein the fastener is one fastener of the plurality of fasteners.

9. A broadhead, comprising:

an elongated body extending along a longitudinal axis, said elongated body having an elongated slot and a passage extending through a portion of the elongated body, said passage intersecting the slot;

a blade at least partially received in the slot when the broadhead is assembled, wherein the blade is configured to pivot relative to the elongated body between a retracted position and a deployed position;

a fastener configured to extend through a hole in the blade received in the elongated slot to retain the blade in the slot such that the blade rotates about the fastener from the retracted position to the deployed position and from the deployed position to the retracted position when the broadhead is assembled; and an annular collar configured to slide onto the elongated body of the broadhead from a rear of the elongated body, said annular collar comprising:

a recess in a forward end of the annular collar; and a channel recessed from an exterior circumferential surface of the annular collar; wherein:

the recess in the forward end of the annular collar is configured to receive the blade of the broadhead when the blade is in the deployed position; and the channel is configured to receive a resilient annular band.

10. The broadhead of claim 9, wherein:

the fastener is configured to threadingly engage the passage while extending through the hole in the blade when the broadhead is assembled.

11. The broadhead of claim 9, further comprising:

the resilient annular band.

12. The broadhead of claim 9, wherein:

a portion of the blade extends into the recess in the forward end of the collar as the blade pivots from the deployed position to the retracted position and back to the deployed position such that the blade maintains alignment of the recess with the blade and blade slot when the broadhead is assembled.

13. The broadhead of claim 9, wherein:

the blade further comprises a hooked protrusion configured to be received in the recess of the annular collar when the blade is in the deployed position; and the hooked protrusion of the blade extends radially from the longitudinal axis of the broadhead less than the exterior circumferential surface of the annular collar when the broadhead is assembled and the blade is in the deployed position.

14. The broadhead of claim 9, wherein:

the blade further comprises a hooked protrusion configured to be received in the recess of the annular collar when the blade is in the deployed position;

the hooked protrusion of the blade extends radially from the longitudinal axis of the broadhead less than the exterior circumferential surface of the annular collar when the broadhead is assembled and the blade is in the deployed position; and the hooked protrusion of the blade extends radially from the longitudinal axis of the broadhead more than a bottom of the channel of the annular collar when the broadhead is assembled and the blade is in the deployed position.

15. The broadhead of claim 9, wherein:

the channel extends longitudinally less than the band such that when the band is in the channel, as the annular collar is slid onto the rear of the elongated body with the blade in the deployed position, the band slides or rolls forward onto a hooked protrusion of the blade while remaining in the channel with respect to the longitudinal axis of the elongated body, securing the blade in the deployed position.

16. The broadhead of claim 9, wherein:

when the band is in the channel, as the annular collar is slid onto the rear of the elongated body with the blade in the deployed position, the annular band becomes longitudinally aligned with and radially outward of a hooked protrusion of the blade such that as the blade is pivoted from the deployed position to the retracted position, the annular band is moved forward with respect to the elongated body and the longitudinal axis of the elongated body onto a rear blunt edge of the blade to secure the blade in the retracted position.

17. The broadhead of claim 9, wherein:

when the band is in the channel, as the annular collar is slid onto the rear of the elongated body with the blade in the deployed position, the annular band becomes longitudinally aligned with and radially outward of a hooked protrusion of the blade such that as the blade is pivoted from the deployed position to the retracted position, the annular band is moved forward with respect to the elongated body and the longitudinal axis of the elongated body onto a rear blunt edge of the blade to secure the blade in the retracted position;

the hooked protrusion of the blade is configured to contact a target upon impact of the broadhead with the target when fired and force the blade from the retracted position to the deployed position.

18. The broadhead of claim 9, further comprising:

a plurality of blades wherein the blade is one blade of the plurality of blades; and a plurality of fasteners wherein the fastener is one fastener of the plurality of fasteners, wherein:

the recess in the forward end of the annular collar is one of a plurality of recesses, and a plurality of the recesses in the forward end of the annular collar are configured to receive a blade of the plurality of blades when the broadhead is assembled with the annular collar having been slid onto the rear of the elongated body.

* * * * *